US005322404A

United States Patent [19]

Keller

[11] Patent Number: 5,322,404

[45] Date of Patent: Jun. 21, 1994

[54] WALL LIFTING DEVICE

[75] Inventor: Bobby E. Keller, 105 Lorraine Ct., Inman, S.C. 29349

[73] Assignee: Bobby E. Keller, Inman, S.C.

[21] Appl. No.: 943,750

[22] Filed: Sep. 11, 1992

[51] Int. Cl.[5] ..... E04G 21/14

[52] U.S. Cl. ..... 414/11; 52/749; 52/DIG. 1; 212/257

[58] Field of Search ..... 414/11, 52; 254/106, 254/105; 52/749, DIG. 1; 212/205, 211, 218, 257

[56] References Cited

U.S. PATENT DOCUMENTS

| | | | |
|---|---|---|---|
| 2,174,525 | 10/1939 | Padernal . | |
| 2,477,922 | 8/1949 | Emery et al. . | |
| 2,727,335 | 12/1958 | Susil . | |
| 2,812,077 | 11/1957 | Proctor . | |
| 3,485,386 | 12/1969 | Miller . | |
| 3,520,383 | 7/1970 | Lóóck . | |
| 3,910,421 | 10/1975 | Panneton | 414/11 |
| 4,648,647 | 3/1987 | Patton | 212/218 |
| 5,054,985 | 10/1991 | Wagatsumo et al. | 414/11 |
| 5,163,799 | 11/1992 | Lynn | 414/11 |

FOREIGN PATENT DOCUMENTS

| | | | |
|---|---|---|---|
| 1164055 | 2/1964 | Fed. Rep. of Germany | 212/257 |
| 2218015 | 10/1973 | Fed. Rep. of Germany | 414/11 |
| 2946750 | 5/1981 | Fed. Rep. of Germany | 414/11 |

*Primary Examiner*—Michael S. Huppert
*Assistant Examiner*—Gregory A. Morse

[57] ABSTRACT

A lifting device for pivotally raising a prefabricated wall section from a substantially horizontal position to a vertical position on the floor of a building under construction comprising a trolley having a frame, a pair of spaced rollers mounted for rotation thereon and defining an opening for receipt and passage therethrough of an elongated beam with the rollers in frictional, gripping engagement with the beam, motors mounted on the frames in operative driving engagement with the rollers, and a hinge pivotally mounted on the frame for attachment to the ultimate upper end portion of a prefabricated wall section to permit pivotal movement of the hinge about its point of attachment to the frame during wall-lifting operations. The trolley travels along the beam as the beam pivots on the floor of the building from vertical to diagonal position during corresponding pivotal movement of the prefabricated wall from horizontal to vertical position.

11 Claims, 6 Drawing Sheets

WALL LIFTING DEVICE

This invention relates to an improved building construction tool or implement, and more particularly, to an improved device for lifting prefabricated wall sections of a building into final vertical position during construction.

BACKGROUND OF THE INVENTION

The construction of buildings with prefabricated wall sections is a common practice. Such prefabricated wall sections, which may vary in length, generally are placed horizontally on the floor of the building structure, with the ultimate lower edge of the horizontal wall section placed immediately adjacent the floor location on which it will rest in vertical, upright position. The wall section is lifted and tilted into its desired vertical position, and the section is then secured to the floor.

It has been suggested to provide lifting devices, such as wall jacks, to raise prefabricated wall sections from horizontal to final vertical position in construction of buildings. U.S. Pat. Nos. 2,812,077 and 3,485,386 each disclose a wall jack construction comprising a mechanical hoist having an elongated boom, the lower end of which is pivotally attached by a hinge to the floor of the building construction. Attached to a lower end portion of the boom is a winch with cable. The cable passes about a sheave on the upper end of the boom, and the outer end of the cable is suitably connected to the prefabricated wall adjacent its eventual upper end. The winch is manually operated to pivotally raise the wall section to a vertical position as the boom pivots from vertical to a generally 45 degree angular position during the lifting operation.

BRIEF OBJECTS OF THE PRESENT INVENTION

It is an object of the present invention to provide an improved lifting device for raising prefabricated wall sections of a building from a horizontal to a vertical, upright position during building construction.

It is a further object to provide an improved, economical, light-weight trolley lifting device for use in building construction which can be transported, employed, and operated by a single workman to lift prefabricated wall sections into vertical position during construction of a building.

BRIEF DESCRIPTION OF THE DRAWINGS

The above, as well as other objects of the invention, will become more apparent and the invention will be better understood from a following detailed description of the invention, when taken together with the accompanying drawings, in which.

SUMMARY OF THE INVENTION

The present invention is an improved lightweight, economical, motorized device for lifting prefabricated building wall sections from a horizontal position to their intended upright, vertical position during construction of a building. The device comprises a motorized trolley which is designed to move along a lifting beam, such as an existing 4"×4" soft wood post typically available as a building material at the construction site.

The trolley includes a generally open, rectangular support frame having a pivotal hinge portion designed to be suitably attached to the eventual top edge of a prefabricated wall section, and a pair of spaced, motor-driven rollers which frictionally grip and engage an elongated rigid member, such as a 4"×4" rectangular pine post. The post serves as a beam, the bottom of which is supported by a building floor and is suitably blocked against sliding movement, and for pivotal movement, by a board fixed to the floor of the building. Motor means carried on the frame of the trolley drive the rollers to move the trolley along the beam as it pivots downwardly from vertical position to lift the prefabricated wall section from horizontal to vertical position. The eventual lower end of the prefabricated wall is suitably fixed to the building construction floor for pivotal movement, and against sliding movement, during the lifting operation.

The lifting device may be easily transported, erected, and operated by a single workman to elevate prefabricated wall sections to upright positions during building construction. Depending upon the weight and/or length of the prefabricated wall section to be lifted, one or more such lifting devices may be employed and operated simultaneously from floor level by an operator to raise the wall section.

DETAILED DESCRIPTION OF PREFERRED EMBODIMENTS

Figure 1:
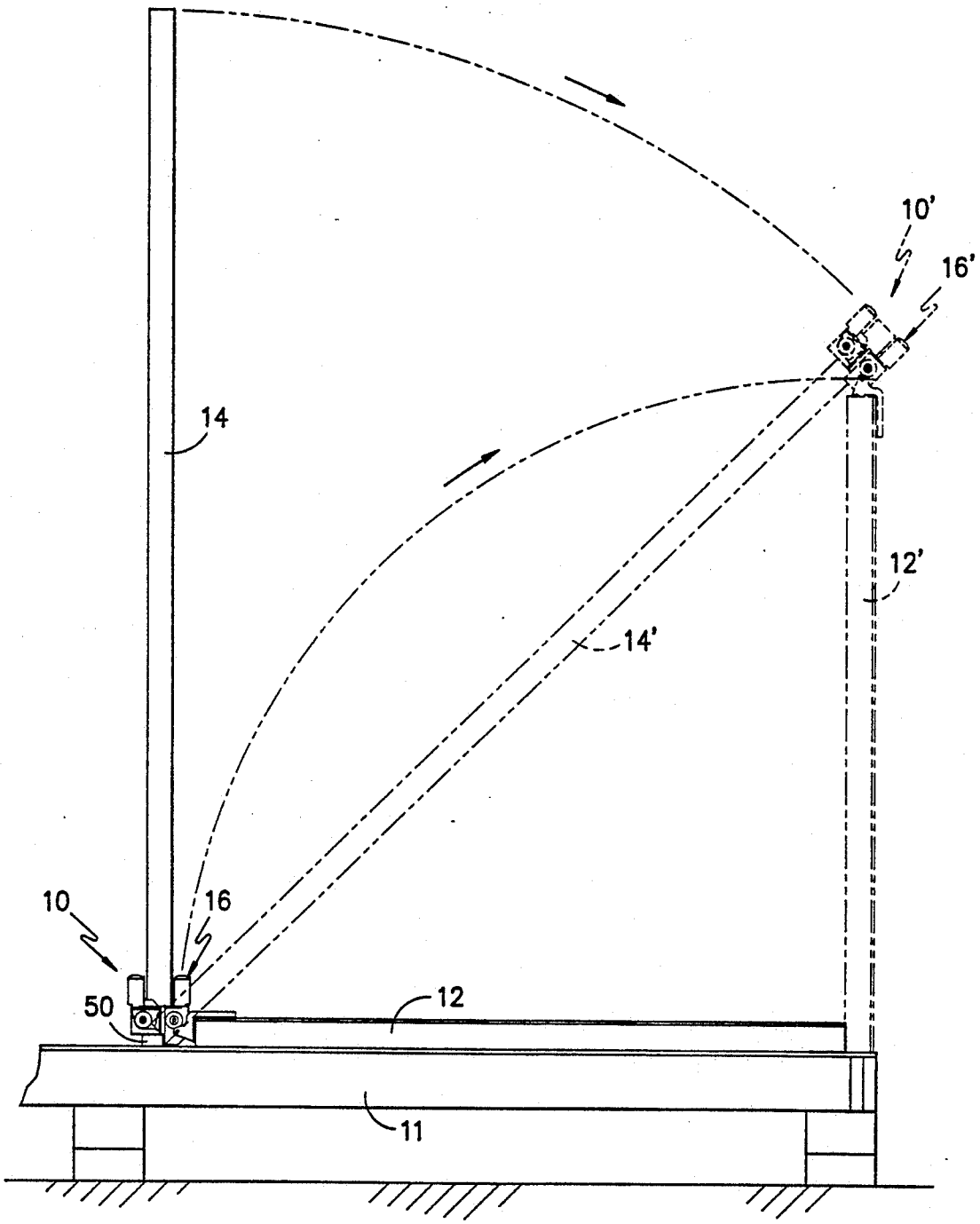
FIG. 1 is a side elevation view of a floor of a building under construction, utilizing the lifting device of the present invention, and illustrating the overall arrangement and use of beam and trolley components to lift a prefabricated wall section from horizontal to vertical position during construction operations.

As best seen in the drawings, FIG. 1 is a side elevation view of a building under construction, showing the overall arrangement, operation, of the device of the present invention and use to lift a prefabricated wall section from a resting, horizontal position to a final vertical position of use. The overall lifting mechanism 10, as shown in solid lines in FIG. 1, is supported on the floor 11 of a building, and is attached to a horizontally disposed wall section 12 at the beginning of the lifting operation. The device, its component parts, and the vertical prefabricated wall section are identified by prime numbers and are represented in broken lines as they would be seen in their final position in lifting the wall.

As shown, the overall lifting mechanism 10 includes an elongated beam 14, which preferably is a soft pine wood 4"×4" post typically available as an on-site building material, and a motor-driven trolley 16 which surrounds the beam and moves therealong during the wall-lifting operation. For lifting 8 foot high wall section, the beam may be typically about 14 feet long.

Figure 2:
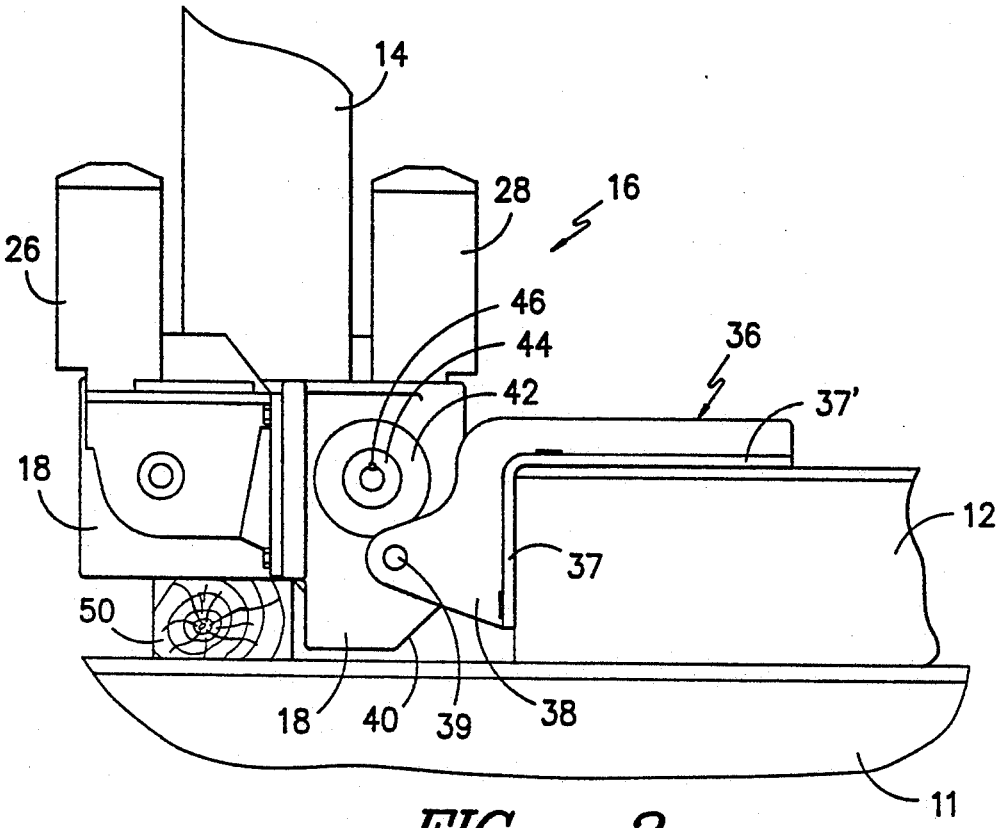
FIG. 2 is an enlarged side elevation view of the lower end portion of the beam, with surrounding trolley as seen in FIG. 1, showing the beam in vertical position and in operative engagement with the floor of a building at the beginning of a lifting operation.
Figure 3:
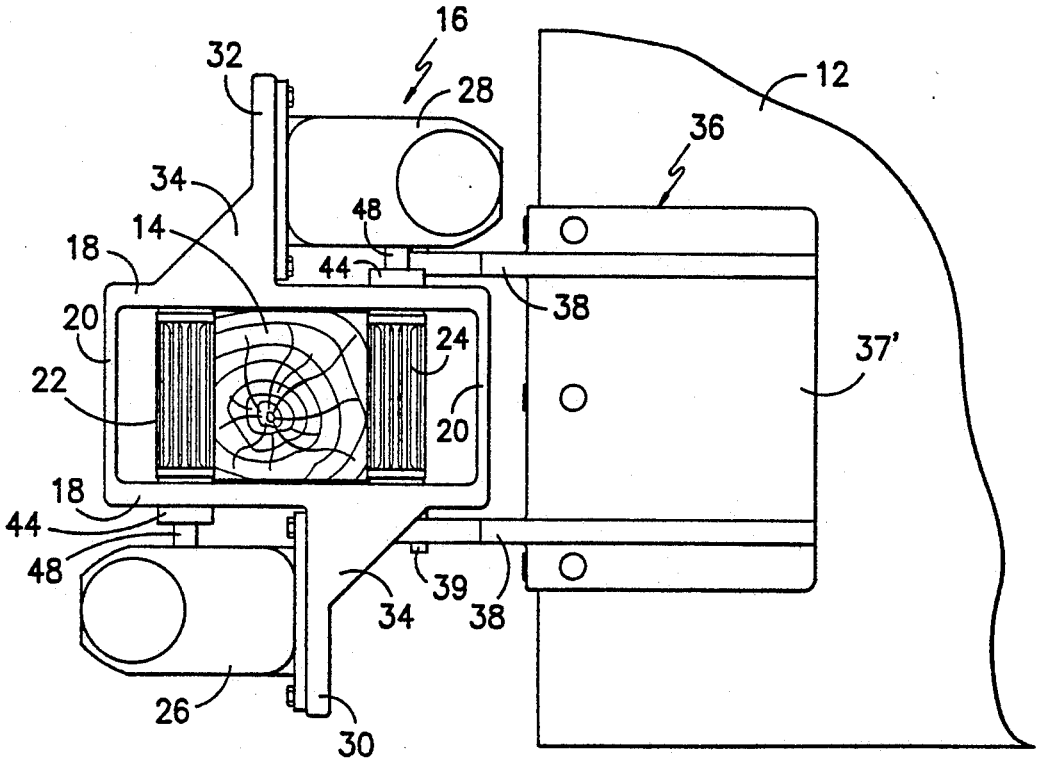
FIG. 3 is a top plan view of the lower end portion of the beam and trolley, as seen in FIG. 2.
Figure 7:
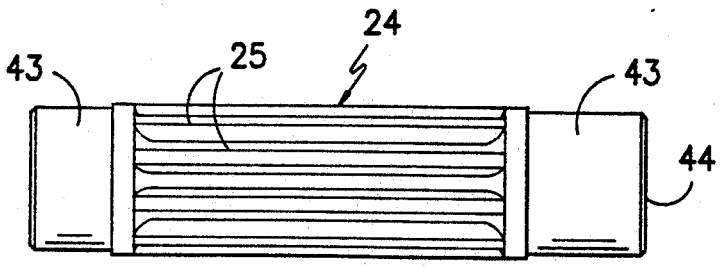
FIG. 7 is a side elevation view of one of the driven rollers of the trolley.
Figure 8:
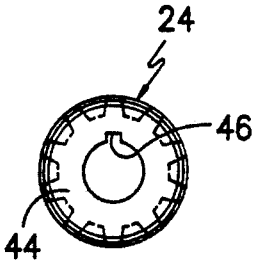
FIG. 8 is a right end view of the roller of FIG. 7.

FIGS. 2 and 3 are respective enlarged side elevation and top plan views of the trolley 16 and lower portion of the beam 14. The beam is shown in vertical position and the trolley is located at the bottom end of the beam at the beginning of the lifting operation, as seen in solid lines in FIG. 1. Trolley 16 comprises a generally rectangular open frame of opposing pairs of walls 18, 20, which supportably carry for rotation therein a pair of spaced, substantially identical motor-driven rollers 22, 24. FIGS. 7 and 8 show in more detail one roller 24 of the pair. Each of the rollers have toothed, or roughened, drive surface 25 to frictionally grip and engage opposite sides of the 4"×4" soft pine beam 14. A pair of electrically driven, reversible gear motors 26, 28 are mounted on outwardly extending walls 30, 32, respectively, of the frame and are operatively connected through right-angle reduction gear to independently drive the two rollers 22, 24. The walls 30, 32 of the frame are reinforced by triangular web reinforcements 34. The walls 18, 20, 30, 32 and reinforcements 34 may be formed of suitable high strength material, such as cast aluminum or molded plastic.

Figure 4:
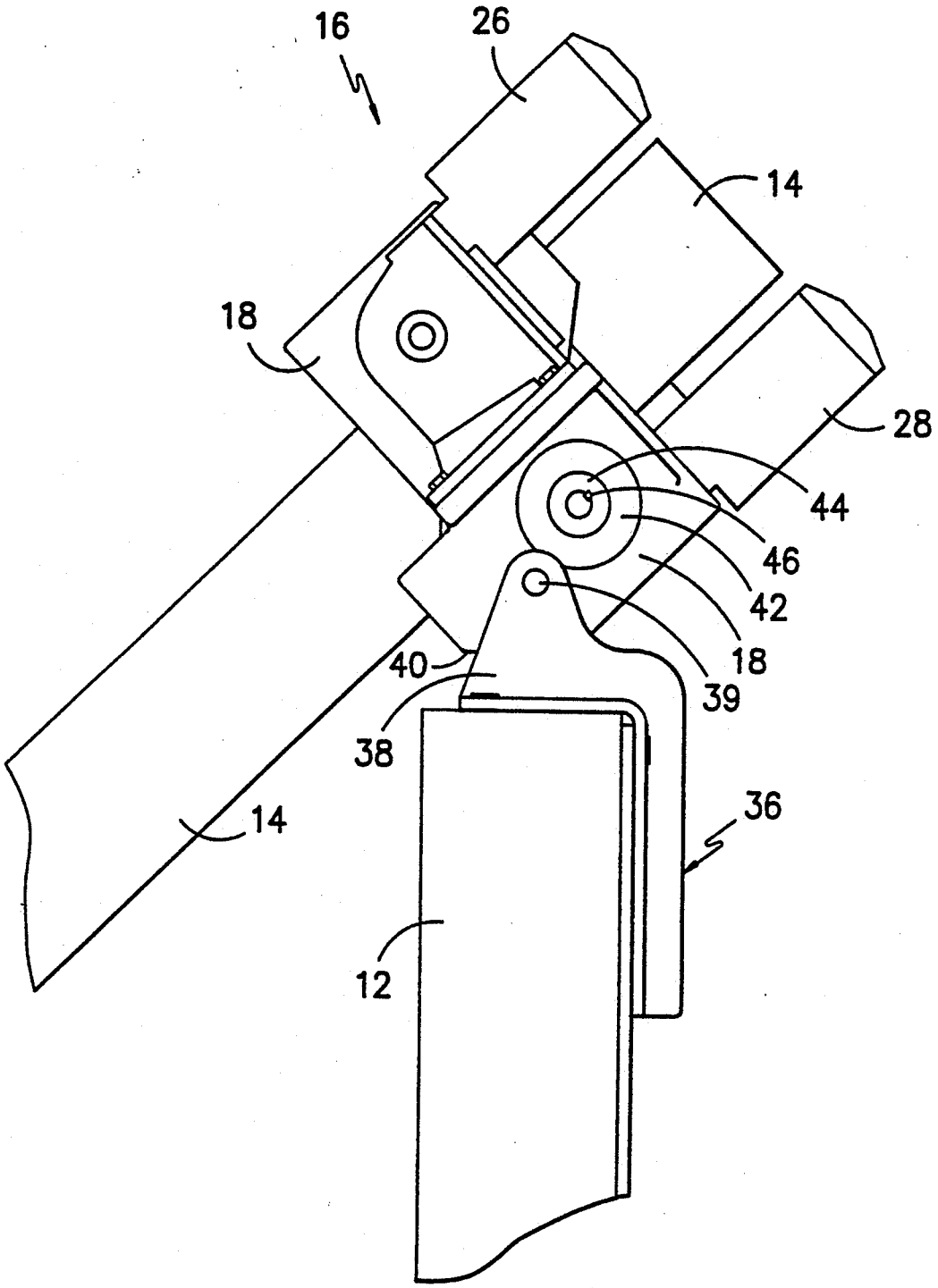
FIG. 4 is an enlarged side elevation view of the upper end portion of the wall section and beam with surrounding trolley which moves along the beam, the trolley being shown located at its uppermost position on the beam at the end of the lifting operation.

The gear motors 26, 28 may be of a suitable type, e.g., an electric motor with right-angle gear motor shaft output, such as an AC/DC motor manufactured by Dayton, Model No. 2Z797. The output gear ratio may typically be approximately 1800/1, such that the gear motors slowly rotate the rollers 22, 24 to move the trolley along the beam 14 during the lifting operation. The frame of trolley 16 carries a hinge 36 consisting of a rectangular plate 37 with flange portion 37', and a pair of generally triangular hinge arms 38 pivotally attached by a pivot pin 39 to opposing side walls 18 of the rectangular frame at point below and outside of the rotational axis of the nearest adjacent roller 24. The lower right edge of each of the side walls 18 of the frame, as seen at 40 in FIGS. 2 and 4, is disposed at a 45 degree angle to permit free pivotal movement and clearance of hinge 36 as it pivots on the frame of the trolley as the trolley moves up the beam 14 during lifting operations. As seen in FIGS. 2, 3, and 4, plate 37 of the hinge is secured to the upper end of the prefabricated wall to be lifted, as by nails, bolts, or the like.

The pair of spaced, motor-driven rollers 22, 24 (FIG. 3) which contact opposite sides of rectangular beam 14 in gripping, frictional engagement are supportably mounted at each of their end portions 43 (FIG. 7) for rotation in the trolley frame by suitable bearing means, such as ball-bearing rings 42 (one of which is seen in FIGS. 2 and 4), which are press fit into openings in the frame walls 18. Each of the rollers 22, 24 has one extending stub shaft portion 44 having a central passageway with keyway 46 adapted to receive in driving engagement therewith a suitably keyed output drive shaft 48 of one of the gear motors. Each gear motor is connected to a suitable source of electrical power, such as AC or DC energy, by electrical wiring (not shown), and may be operated in forward or reverse directions from suitable control means, or devices, located at floor level for use by a single workman operator.

Figure 6:
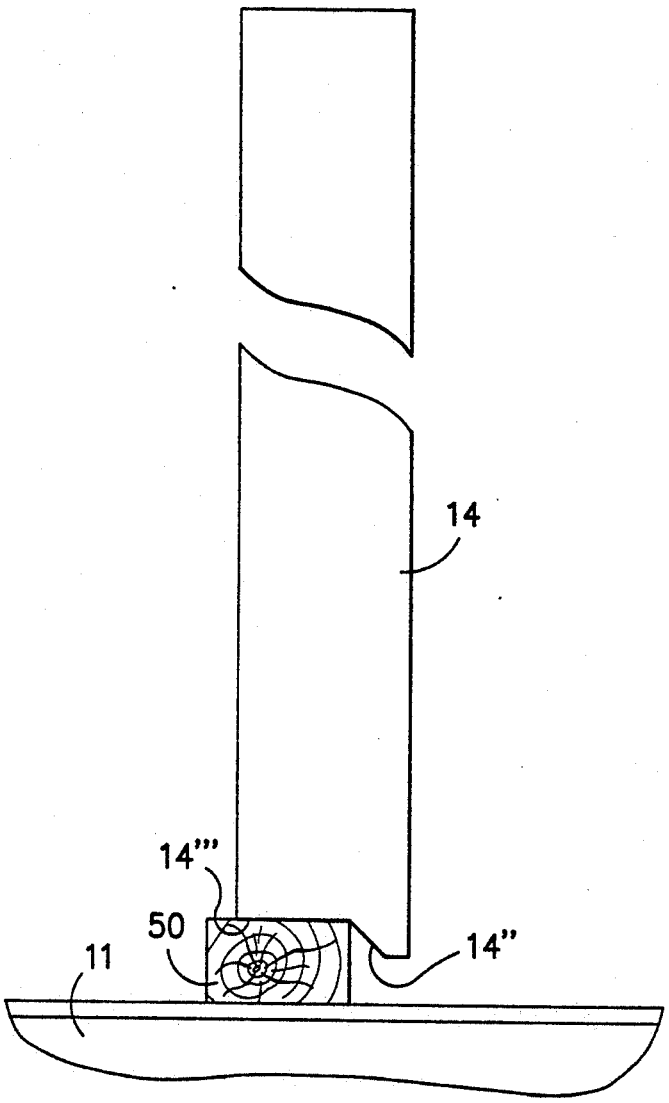
FIG. 6 is an enlarged side elevation view of the bottom portion of the beam, only, in a vertical position.

As best seen in FIG. 6, a portion of the bottom end surface of the 4"×4" beam is cut away, at a 45 degree angle, as at 14", to form a base portion 14"' which rests upon a suitable stop member, such as a suitable length, e.g., 30 inches, 2"×4" board 50, which is nailed to the floor 11 of the building construction. The beam of the lifting device is thus fixed against sliding movement, and for pivotal movement, about an edge of the 2"×4" board as it pivots from a vertical position to a 45 degree diagonal position during the lifting of the prefabricated wall section, as shown in broken lines in FIG. 1.

Figure 5:
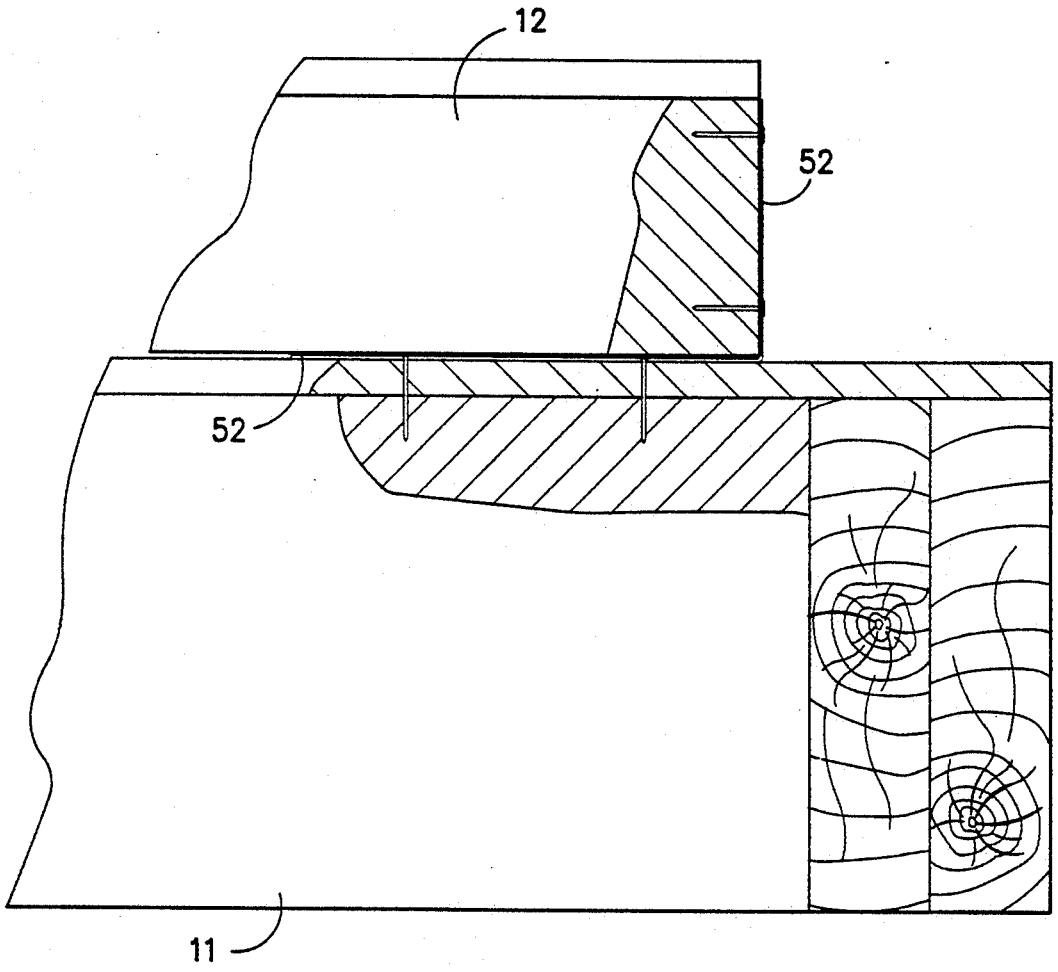
FIG. 5 is an enlarged side elevation view of only the right end portion of the building floor and bottom of a horizontally disposed wall section as shown in FIG. 1, before the wall is lifted.

FIG. 5 is an enlarged side elevation view of a portion of the ultimate lower end of the prefabricated wall section 12 and the supporting floor section 11. As seen, the ultimate lower end of wall section 12 is fixed against sliding movement, but for pivotal movement about its lower end, during the lifting operation by suitable fastening means, such as flexible metal bands, one of which, 52, is shown. The bands are attached to the floor and wall section at spaced locations therealong by suitable means, such as nails.

FIG. 4 is an enlarged side elevation view of the upper portion of the beam with trolley attached to the upper end of the prefabricated wall section 12. FIG. 4 shows in full line presentation the position of the trolley 16 and upper end of the beam 14 at the completion of the lifting operation. As is evident from FIGS. 1 and 4, trolley hinge 36 attached to the upper end of the wall section 12 pivots about pivot point 39 as the trolley moves up the beam and the beam 14 pivots downwardly to a final approximate 45 degree angle when the wall section 12 is in vertical position.

Figure 9:
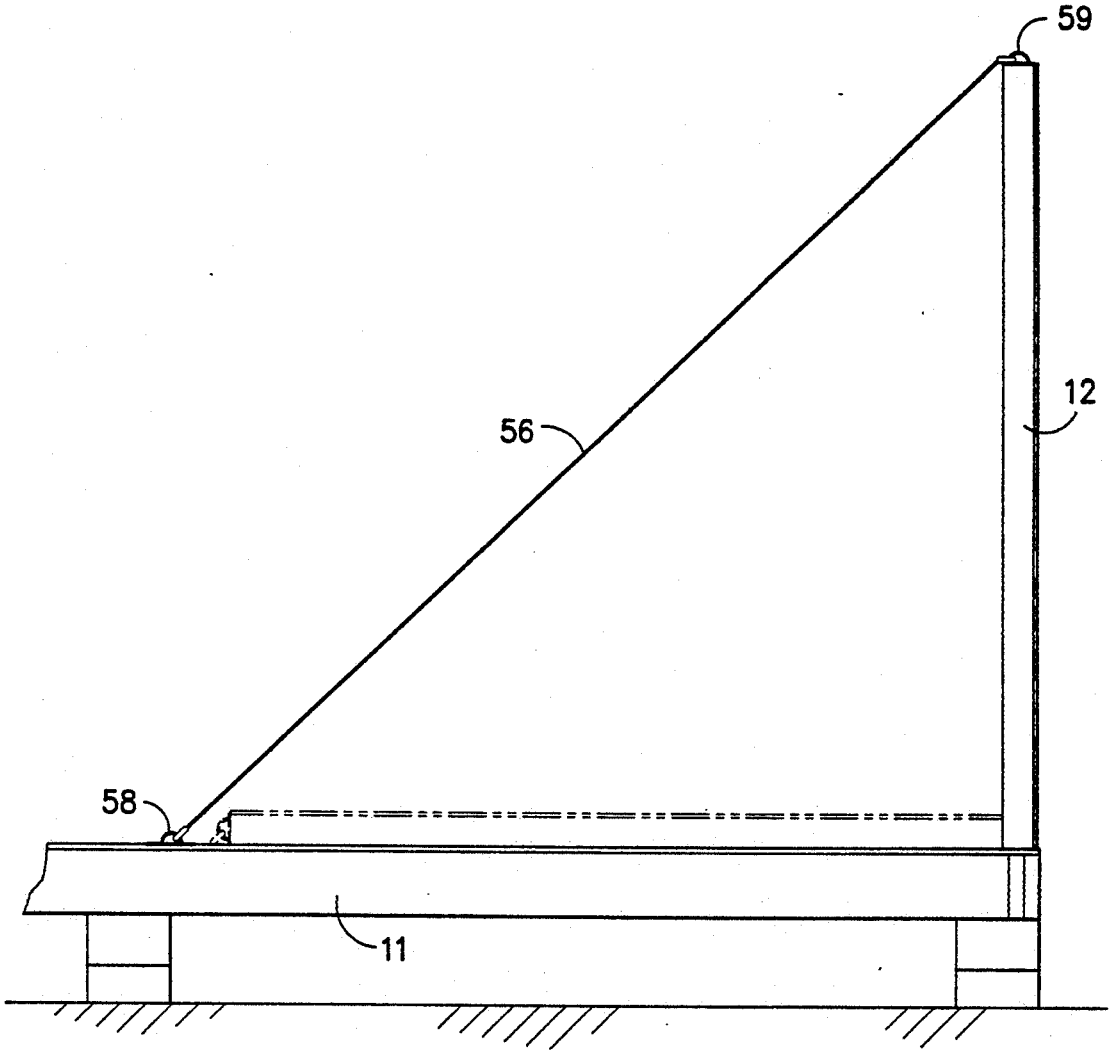
FIG. 9 is a side elevation view of a floor of a building under construction, as in FIG. 1, but illustrating flexible connection means for use with the beam and trolley for retention of the wall section in vertical position until its positive securement to the building floor.

To facilitate retention of the preformed wall section 12 in vertical position and resist its movement past the vertical, in the direction of its pivot, until it can be firmly secured to the floor 11, one or more flexible elements, or cables 56, may be employed and attached by eye plates 58, 59 to the floor 11 and upper end of the wall 12 at spaced locations along the length of the wall. One of the cables 56 is illustrated in FIG. 9. The retaining cables 56 may be spaced along the length of wall 12 near or between adjacent lifting devices and resist displacement of the lower end of the beam and further pivotal movement of the wall past a vertical position. The effective lengths of the wall-retaining cables 56 employed are determined by the height of the wall to be lifted and thin attachment points to the floor and wall. Typically, the cables may have an effective length equal to the length of the hypotenuse of the right angle formed by the wall in horizontal and vertical positions, plus about six inches, to compensate for the positions of the eye plates on the floor and wall section.

Certain motor-driven devices have been disclosed for trimming tree trunks and for climbing tree and pole-like objects. U.S. Pat. Nos. 2,477,922; 2,727,335; 2,174,525; and 3,520,383 disclose such devices. However, it is not known that motorized trolley-type lifting devices of the type disclosed herein have ever been employed in the building industry to effect pivotal vertical erection of prefabricated walls from a horizontal position. In this regard, it has been found that pressures and moments of force on the lifting trolley 16 as it moves along the pivoting beam vary greatly, and the design of the trolley and location of hinge 36 of the present invention are such that the driven rollers 22, 24 at all times positively engage the beam during the lifting operation. As seen in FIGS. 3 and 4, the pivot point of the hinge of the trolley is located relative to the rotational axes of the driven rollers and the central longitudinal axis of the beam moving therebetween to accommodate attachment to the wall and provide optimum driving engagement of the rollers with the beam during lifting operations. It is also desirable that the motors be positively driven in forward and reverse directions to ensure positive retention and positioning of the heavy prefabricated wall sections during their upward travel to vertical position.

From the foregoing, it can be appreciated that the lifting device of the present invention may be economically constructed, operated, and transported between sites of operation. The motorized trolleys may be assembled with existing on-site wood beam materials and operated by a single individual worker to lift preformed wall sections of a building during construction. Depending upon the length and weight of the wall section to be lifted, the wall section may be reinforced to prevent excessive bending and/or one or more lifting devices may be employed along the length of the wall and operated simultaneously from a floor location by a single operator to raise the wall to vertical position.

That which is claimed is:

1. In combination with an elongated beam having a length and a prefabricated wall section having an ultimate upper end, a trolley adapted for movement along the elongated beam to lift the prefabricated wall section from a horizontal to a vertical position, said trolley comprising;

a frame, a pair of rollers mounted for rotation on said frame and defining with said frame an opening for receipt and passage therethrough of the elongated beam wherein the rollers are in frictional gripping engagement with the beam, motor means mounted on said frame in operative driving relation with said rollers, hinge means pivotally mounted on said frame and having means for attachment to the ultimate upper end portion of the prefabricated wall section to permit pivotal movement of said hinge means about its point of attachment to the frame of the trolley, and wherein said beam comprises means for mounting the beam on the floor of a building under construction against sliding movement along the floor and for pivotal movement of the beam from a vertical position to a diagonal position as the trolley moves along the beam and lifts the wall section from a horizontal to a vertical position during a wall lifting operation.

2. A trolley as defined in claim 1 wherein said frame is of generally rectangular shape and comprises two pair of opposed upstanding spaced sides, bearing means mounting said rollers for rotation in opposed, spaced relation in one pair of said opposed spaced sides of the frame to define with said frame said opening for passage of an elongated beam therethrough, and said hinge means comprising a hinge body including a plate and a pair of spaced depending hinge arms, and means pivotally mounting said hinge body by its arms to said one pair of opposed side members for pivotal movement about an axis parallel to the axes of rotation of the rollers and below the plane of the axis of rotation of the rollers to one side of the longitudinal axis of said opening of the frame to permit pivotal movement of said hinge means about its point of attachment to the frame of the trolley during wall-lifting operations.

3. A trolley as defined in claim 2 wherein said frame includes a pair of side members extending perpendicularly outward from respective of said one pair of opposed side members, said motor means comprises a pair of motor means, and means mounting one of said pair of motor means on each of said outwardly extending side members in operative driving engagement with an adjacent one of said rollers.

4. A trolley as defined in claim 2 wherein said frame is of high-strength cast aluminum construction.

5. A trolley as defined in claim 2 wherein each of said pair of rollers has a roughened peripheral surface for frictional gripping engagement with sides of a beam passing through said opening of the trolley to facilitate retention and positive positioning of the trolley along an elongated beam.

6. A lifting device for pivotally raising a preformed wall section from a substantially horizontal position to a vertical position on the floor of a building under construction comprising a rigid, elongated beam, means for mounting the beam on the floor of a building under construction against sliding movement along the floor and for pivotal movement of the beam from a vertical to a diagonal position during a wall-lifting operation, a trolley comprising a frame, a pair of spaced parallel rollers mounted for rotation on the frame and defining with the frame an opening for receiving the beam for passage therethrough with the rollers in frictional gripping engagement with the beam, motor means mounted on the frame of the trolley in operative driving relation with said rollers to move the rollers along the length of the beam during wall-lifting operations, and hinge means pivotally mounted on said frame and including means for attachment to the ultimate upper end portion of a prefabricated wall section to permit pivotal movement of the hinge means about its point of attachment to the frame of the trolley as the trolley moves along the length of the beam during the wall-lifting operation.

7. A lifting device as defined in claim 6 including wall retaining means comprising at least one elongated flexible element having means at its end portions for attachment to the ultimate upper end of a prefabricated wall section to be lifted and to the floor of a building structure, respectively, said element being of sufficient length to restrict further pivotal movement of a wall section beyond its vertical position in the direction of its pivotal movement during the lifting operation when the element is attached to the floor and the ultimate upper end of the wall section being lifted.

8. A device as defined in claim 7 wherein the flexible element is a flexible cable.

9. A device as defined in claim 6 including means for securing the ultimate lower end of a wall section to be lifted to the floor of a building construction for pivotal movement from horizontal to vertical position during the lifting operation.

10. A device as defined in claim 9 wherein said securing means are flexible metal bands for attachment to the ultimate lower end of a wall and floor of a building construction.

11. A device as defined in claim 6 wherein said beam is a rectangular, elongated, soft wood post.

* * * * *